US005803294A

United States Patent [19]

Bello et al.

[11] Patent Number: 5,803,294

[45] Date of Patent: Sep. 8, 1998

[54] CONTAINER FOR CONSERVATION AND CONSUMPTION OF SEVERAL FOODSTUFFS—FOODS AND BEVERAGES

[76] Inventors: Zvonimir Bello, Tatzelwurmweg 7, 82031 Grünwald, Germany; Sinisia Klein, Gortanova 28, 4100 Zagreb, Croatia

[21] Appl. No.: 765,057

[22] PCT Filed: Jun. 26, 1995

[86] PCT No.: PCT/EP95/02489

§ 371 Date: Dec. 18, 1996

§ 102(e) Date: Dec. 18, 1996

[87] PCT Pub. No.: WO96/00177

PCT Pub. Date: Jan. 4, 1996

[30] Foreign Application Priority Data

Jun. 27, 1994 [HR] Croatia ..... P940374A
Sep. 20, 1994 [HR] Croatia ..... P941035A

[51] Int. Cl.[6] ..... B65D 21/02

[52] U.S. Cl. ..... 220/4.27; 220/751; 220/503; 220/23.83; 220/23.86

[58] Field of Search ..... 220/23.83, 23.86, 220/574, 4.26, 4.27, 503, 504, 751, 754

[56] References Cited

U.S. PATENT DOCUMENTS

| | | | |
|---|---|---|---|
| D. 241,600 | 9/1976 | Ashton | 220/4.27 |
| 1,612,107 | 12/1926 | Falk . | |
| 4,082,208 | 4/1978 | Lane, Jr. | 220/4.27 |
| 4,428,145 | 1/1984 | Wheeler | 220/4.27 |
| 4,483,440 | 11/1984 | Ware | 220/503 |
| 5,065,875 | 11/1991 | Balavich . | |
| 5,272,890 | 12/1993 | Penxa | 220/23.83 |
| 5,423,445 | 6/1995 | Montanari et al. | 220/23.83 |
| 5,445,276 | 8/1995 | Gordon | 220/23.83 |

FOREIGN PATENT DOCUMENTS

| | | |
|---|---|---|
| 9313882.2 | 12/1993 | Germany . |
| 126597 | 5/1919 | United Kingdom . |
| 9325453 | 12/1993 | WIPO . |

OTHER PUBLICATIONS

WO 96/00177 International Search Report, Bello et al., Published 4 Jan. 1996 in International Appln. No. PCT/EP95/02489.

*Primary Examiner*—Stephen J. Castellano
*Attorney, Agent, or Firm*—Baker & Botts, L.L.P.

[57] ABSTRACT

The invention concerns a container for conserving different solids and/or liquids, especially foodstuffs, for example chocolate bars, peanuts or the like, and/or beverages, and for delivering these via an accordingly provided opening, having a main chamber and at least an additional chamber and/or at least a recess, whereby the main chamber and the at least one additional chamber and/or the least one recess are separated from each other by a wall or the like partition wall for avoiding a mutual contact of the different solids and/or liquids kept in the container.

9 Claims, 6 Drawing Sheets

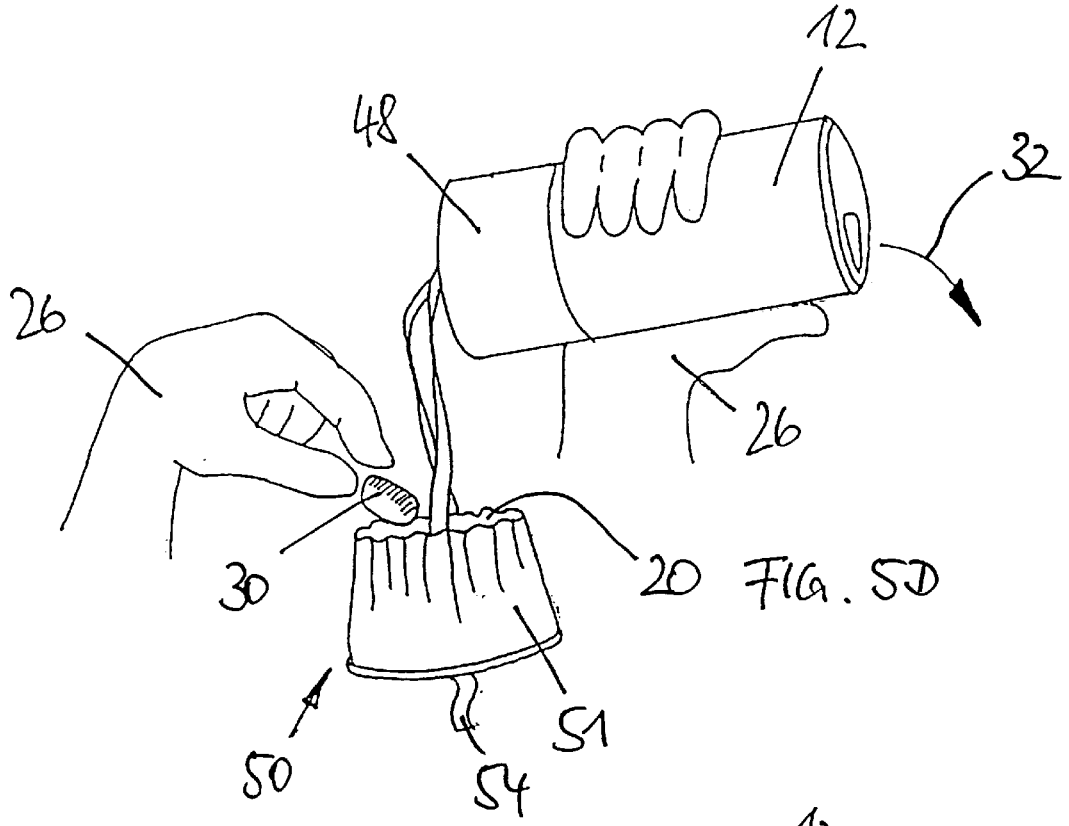
FIG. 5D
FIG. 5E
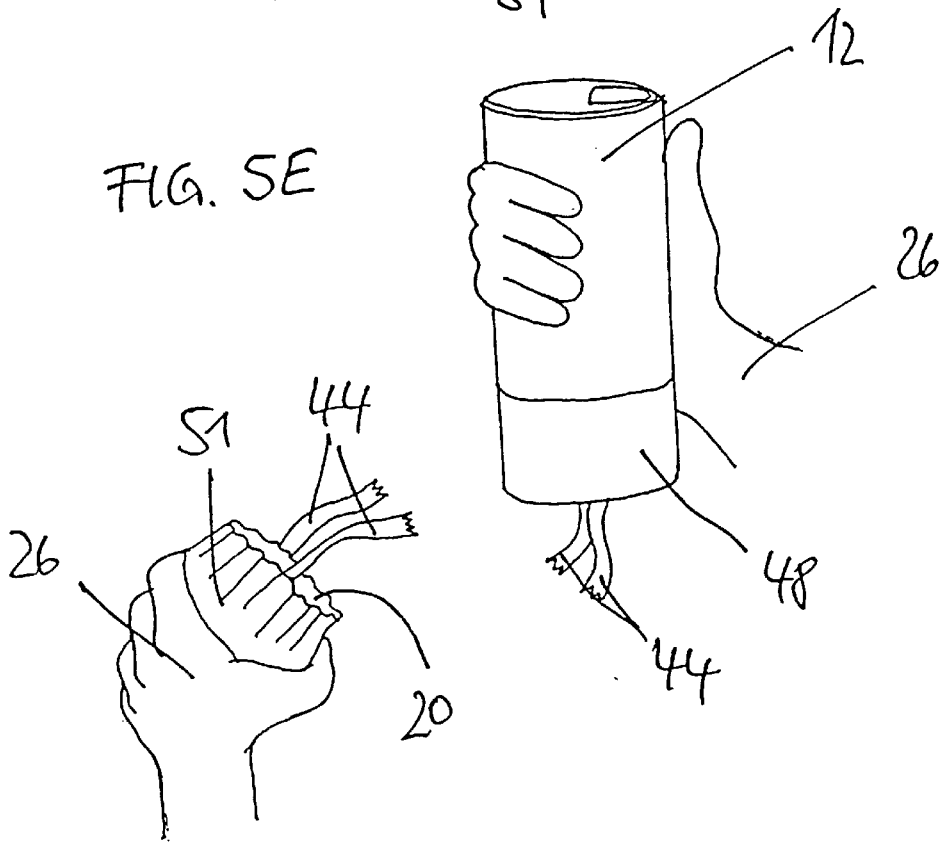

CONTAINER FOR CONSERVATION AND CONSUMPTION OF SEVERAL FOODSTUFFS— FOODS AND BEVERAGES

BACKGROUND OF THE INVENTION

The invention concerns a container, for example a preserve, bottle or can, for receiving and conserving, respectively, of different solids and/or liquids, in particular foodstuffs, for example chocolate bars, peanuts or the like and/or beverages, and for delivering such by a correspondingly provided opening for their consumption.

So, for example, DE-U-93 13 882 shows a bottle of beverage which is provided with a closed pocket extending to the interior and the bottom side at its circumference wall for receiving a little sample bottle or the like container for conserving beverages or solids, for example berries, spices etc.

Furthermore, it is known from GB-A-126,597 and U.S. Pat. No. 1,612,107, respectively, each a container in form of a bottle for conserving different solids and/or liquids, for example an unfoldable container and a cherry, respectively, and/or beverages and sirup, respectively, and for removing these by an accordingly provided opening. Each container is provided with a main chamber and at least one additional chamber or the like. Thereby, the main chamber and the at least one additional chamber are separated from each other by a wall or the like partition wall for avoiding a mutual contact of the different solids and/or liquids conserved in the container.

Finally, U.S. Pat. No. 5,065,875 shows a container in form of a bottle for conserving liquids, in particular foodstuffs, and for removing these by an accordingly provided opening. A recess is provided in this container in which a further container of smaller dimensions in form of a bottle or ampull is provided for receiving a liquid. While and before consumption, respectively, the content of the smaller container can be mixed with the content of the greater container upon removal from the cavity. Both containers, however, are not connected to each other in a way that they might not get lost.

SUMMARY OF THE INVENTION

Starting from this state of the art, the invention now has the object to provide a container, as a preserve, bottle or can, in which two different products simultaneously can be contained for their consumption, which, however, are not in contact with each other and therefore do not mix so that their consumption is possible which is combined or separated on the one hand and which is very easy on the other hand.

The subject-matter of the invention is to provide a container, as a preserve, bottle or can, which in contrast to existing types of containers is consisting of two or more chambers being separated from each other and separated containers, respectively, forming together a unit. The foodstuffs and beverages do not contact with each other in the container of the invention and therefore cannot mix with each other. At the same time, however, the foodstuffs and beverages can be consumpted via said openings at the chambers in a separate manner or together in a simultaneous manner with respect to the connecting elements provided according to the invention, as flexible strips or the like, interposed between the main chamber and the at least one additional chamber.

The additional chambers can be conserved within the container in form of a preserve, bottle or can such that the corresponding opening is at the lower side and at the bottom, respectively, of the main chamber and the container (preserve, bottle or can), respectively, or at the top side, if possible beside the opening of the main chamber and the container (preserve, bottle or can), respectively. However, it is also possible to dispose the at least one additional chamber in the portion of the side wall and the envelope, respectively, of the main chamber and the containers (preserve, bottle or can), respectively.

The number, dimensions, form and arrangement of the at least one additional chamber can be different according to requirements and demands and can be also optionally chosen as a function of the respective size and the respective dimensions of the container itself.

The openings of the main chamber and/or the least one additional chamber can be formed without a closure or in a closable manner by a closure, especially by a sheet of aluminium, plastic material or the like, a cardboard, an adhesive label etc.

According to another embodiment of the invention, the container, i.e. the preserve, bottle or can, comprises two or more separable chambers and containers, respectively, which are preferably connected to each other by flexible strips or the like connecting elements. The container, i.e. the preserve, bottle or can, and the main chamber, respectively, have bands by which the at least one additional chamber and the at least one supplemental container, respectively, are connected which are hanging preferably beneath the main container, i.e. the preserve, bottle or can, and the main chamber, respectively, in use. By removal of the strips the additional container can be separated from the main container. Each container has an individual opening via which the foodstuffs or beverages can be removed.

Moreover, in this embodiment there is the possibility that one or more further additional containers can be added to the additional container also by means of further strips, which are hanging also preferably beneath the respective upper additional containers with respective strips in use.

According to another further embodiment of the invention, the container, i.e. the preserve, bottle or can, with the main chamber has a so-called additional bag or the like container instead of the at least one additional chamber and the at least one additional container, respectively, which is also connected to the container and the main chamber, respectively, by strips and hangs beneath the container, i.e. the preserve, bottle or can, and the main chamber, respectively, on the strips in use. This additional bag is conserved in an accessory part before use which is tightly connected with the container and the main chamber, respectively. The bag has a compact bottom in its bottom side which is connected with the lower edge of the accessory part of the container and the main chamber, respectively, before use of the bag. At said rigid bottom side of the bag is an element for example being in form of a loop or the like for pulling the bag together with the bottom side and the bottom, respectively, out of the accessory part of the container and the main chamber, respectively. The accessory part of the container and the main chamber, respectively, and the rigid bottom of the bag form a closed chamber and a closed container, respectively, before use within which the bag with its content is disposed. The content is protected in this manner against damages, dropping out and going off. The container and the main chamber, respectively, and the bag each have individual openings each serving for the removal of the content provided for consumption. By detachment and removal, respectively, or by separating the strips the bag can completely be separated from the container and the main chamber, respectively.

Furthermore, in this embodiment the possibility exists to combine several bags, then each preferably hanging beneath the container and the main chamber, respectively, wherein then each last and lowest, respectively, bag has a rigid bottom with an element for pulling off.

BRIEF DESCRIPTION OF THE DRAWINGS

Further features, advantages and details of the invention are shown in the following description of some preferable embodiments of the invention as well as with respect to the drawings, representing.

DESCRIPTION OF PREFERRED EMBODIMENTS

Figure 1A:
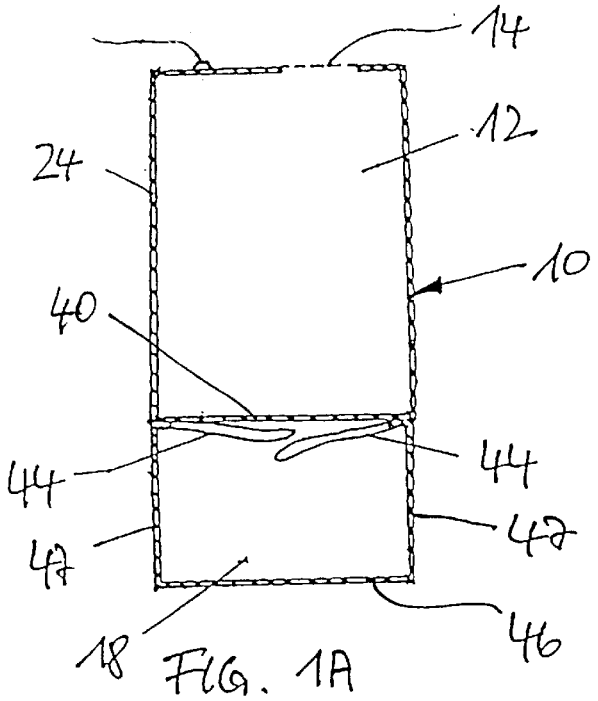
FIGS. 1A and 1B sectional views through an embodiment of the container according to the invention in form of a standard preserve and standard can, respectively, before use and in use, FIGS. 2A, 2B, 2C, 2D and 2E schematic views of the container according to the invention with respect to FIGS. 1A and 1B in use, FIG. 3 a sectional view through a slightly changed embodiment of the container according to the invention with respect to FIGS. 1A and 1B having several additional chambers, FIGS. 4A and 4B partially schematic sectional views through a further embodiment of the container according to the invention in form of a standard preserve and a standard can, respectively, before and in use, FIGS. 5A, 5B, 5C, 5D and 5E schematic views of the container according to the invention with respect to FIGS. 4A and 4B in use, and FIG. 6 a sectional view through a slightly changed embodiment of the container according to the invention with respect to FIGS. 4A and 4B having several additional containers.
Figure 1B:
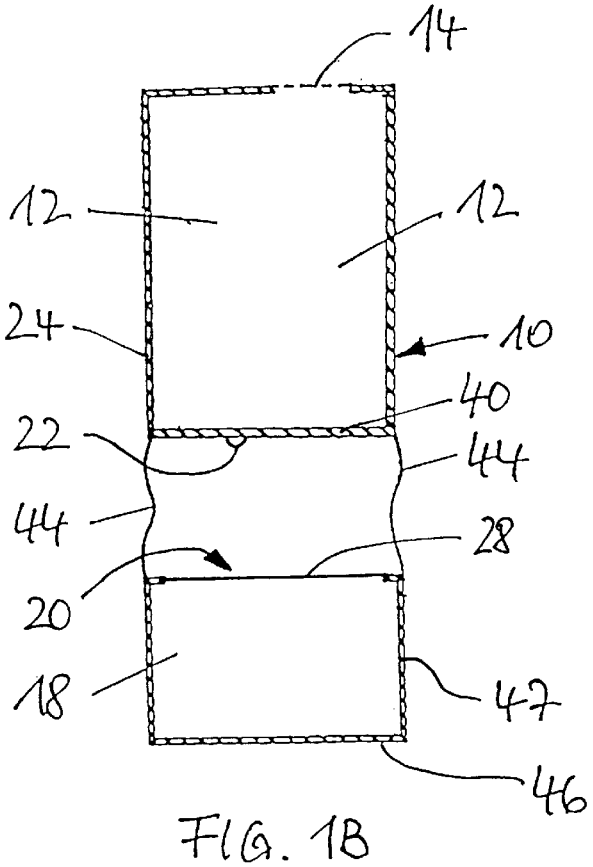

The embodiment of a container 10 according to the invention, as shown in FIGS. 1A and 1B, in form of a preserve or can is composed by a main chamber 12 having an opening 14 at the top side 16 of the container 10 and one or more additional chambers 18 with respective openings 20 at the bottom side 22 of the container 10. The contents of the main chamber 12 and the additional chamber(s) 18 are not in contact with each other because of the impermeability of a common wall 24 or partition wall 40, respectively. An admixture of for example the liquid in form of a beverage in the main chamber 12 and of a solid in form of a chocolate bar or of peanuts in the additional chamber 18 is therefore excluded.

The additional chamber 18 can be completely within the container 10, respectively, i.e. within the preserve or can, whereby its opening is disposed at the bottom side 22 (see FIG. 3) of the container 10, i.e. at the container bottom of the preserve or the can, respectively, namely opposite to the opening 14 of the main chamber 12 at the top side of the container 10. However, an inverted arrangement of main chamber 12 and additional chamber 18 within the container 10 is also possible.

Figure 2A:
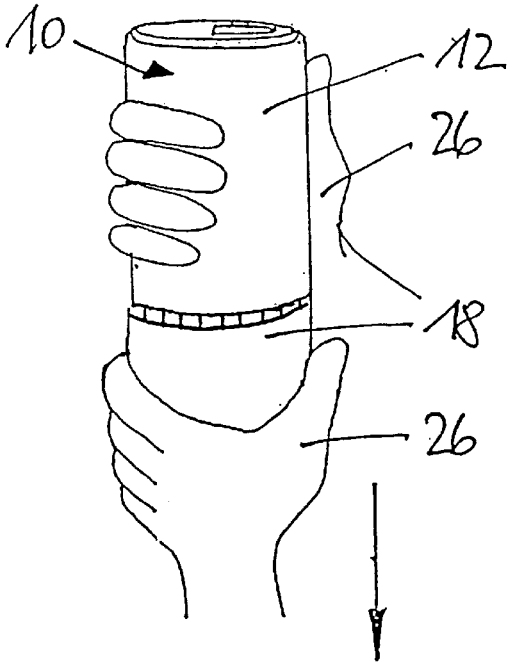
Figure 2B:
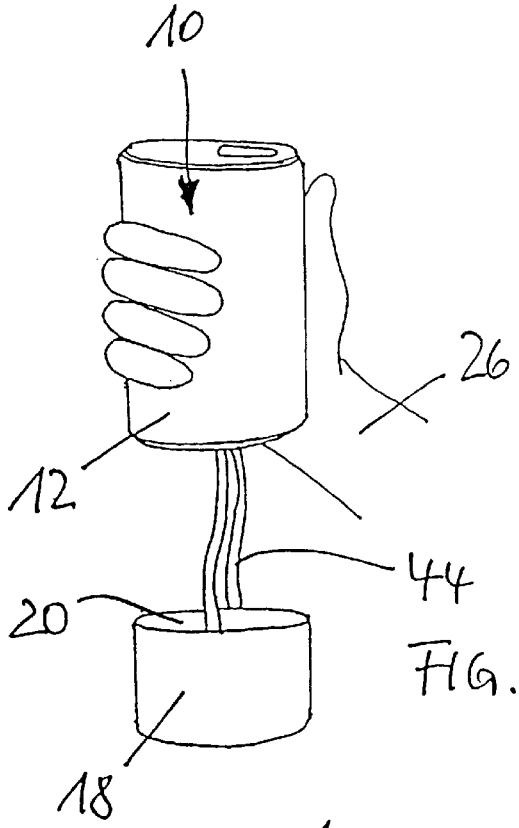
Figure 2C:
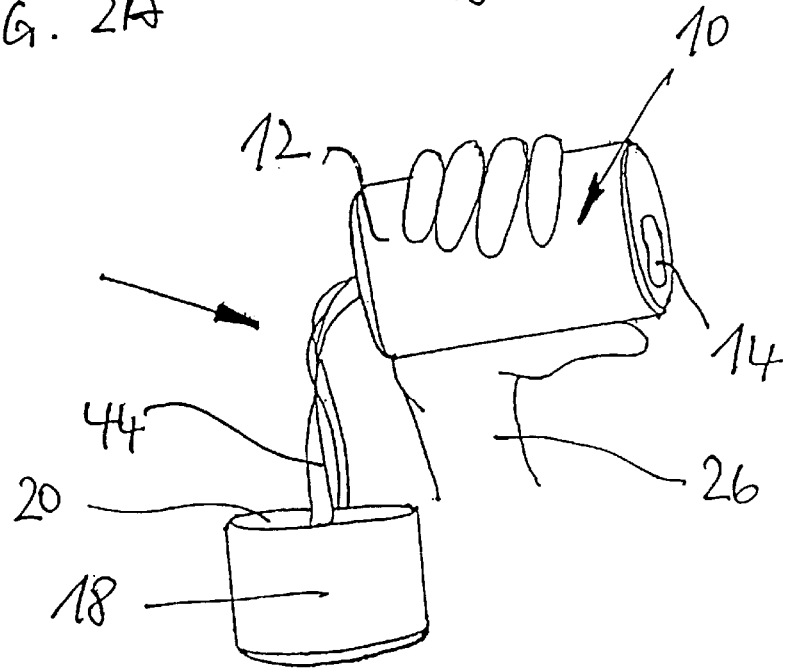
Figure 2D:
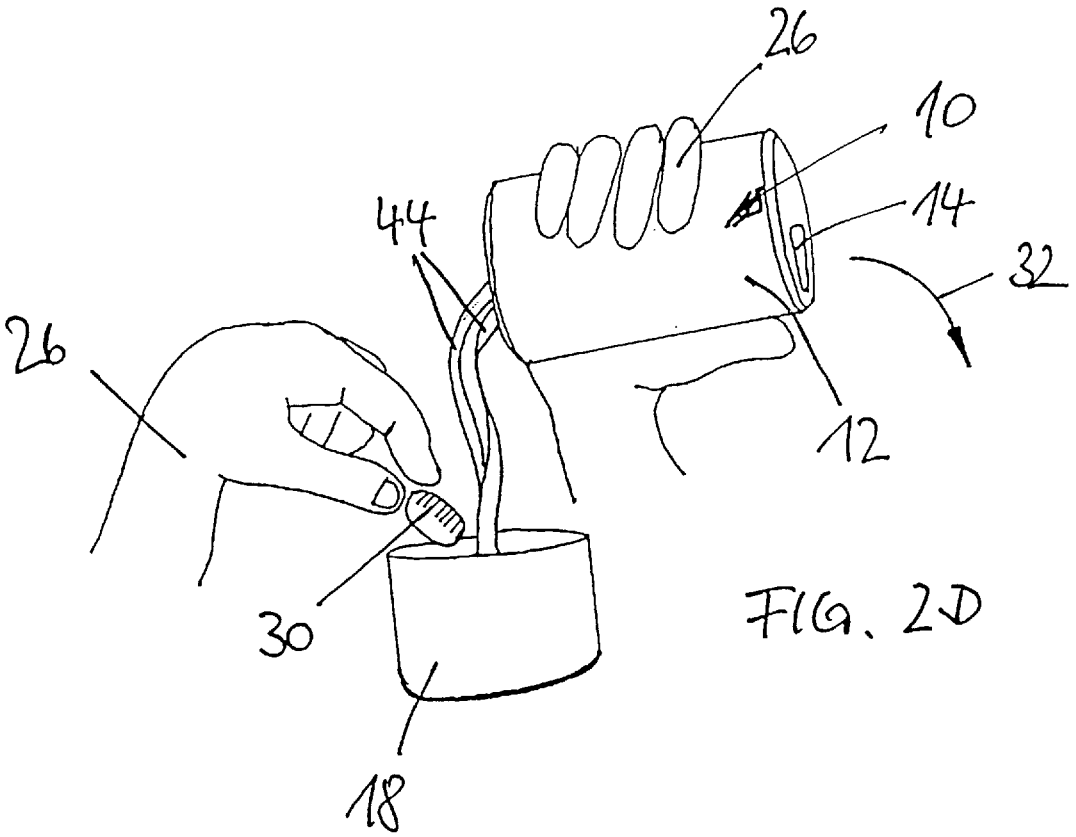

With respect to FIGS. 2A, 2B and 2C from the container 10 according to the invention a foodstuff, for example biscuits, a chocolate bar or peanuts 30 etc., can be taken out off the additional chamber 18 by hand via the opening 20 upon removal of a possibly provided closure 28 (see FIG. 1B) and eat or consumpt it, respectively, meanwhile a beverage 32 is consumpted in a usual manner via the opening 14 of the main chamber 12 of the container 10, respectively. The size and quantity of the foodstuff which can be removed from the container 10 beside the beverage 32, as for example beer or the like, is a function of the number and size of the additional chambers 18 as well as of the size and form of the main chamber 12.

As a function of the arrangement and the constructive embodiment of the main chamber 12 and additional chamber 18 and their openings 14, 20 which can be arbitrarily chosen, the most different closures 28 of the openings 14, 20, as for example a sheet of aluminium, plastic material or the like, a cardboard, an adhesive label etc., can be used.

With the container 10 according to the invention on the one hand, a first product, for example a beverage or juice, can be removed via the opening 14, which connects the main chamber 12 or one of the containers, respectively, with the environment and a further product, for example peanuts 30, can be removed via the opening 20, by which the additional chamber 18 and a further container communicates with the environment on the other hand. In this example, a closing system known per se in form of a screw cap or the like also may be provided as closure 28 for the opening 20 of the additional chamber 18.

The embodiment of a container 10 according to the invention shown in FIGS. 1A and 1B consists of the main chamber or a main container 12, respectively, and the additional chamber or an accessory container 18, respectively, being connected to each other by flexible strips or bands 44 or the like connecting elements. With respect to FIG. 1A the main chamber 12 and the additional chamber 18 can be connected to each other by a plugging-in-, locking-, snapping-, turning-, screwing- or the like means not shown in more detail. It is also possible to fix the main chamber 12 and the additional chamber 18 only by an adhesive sheet as known per se up to the removal of the articles being conserved in the container 10.

The strips or bands 44 are within the additional chamber 18 together with the articles received therein before use. But it is also possible to directly dispose the strips or bands 44 at the outer side of the wall 24 of the complete container 10.

The additional chamber 18 thereby comprises a bottom plate 46, in particular being essentially rigid and a side wall 47 in particular being essentially rigid fixed thereto which is adjacent to the wall 24, here to the bottom side 22, of the main chamber 12.

The additional chamber 18 remains hanging on the respective strips or bands 44 upon removal of the main chamber 12.

With respect to FIGS. 2A to 2E, the main chamber 12 of the container 10 can be held with one hand 26, the additional chamber 18 with the other hand 26 (see FIG. 2A). Upon taking off the plugging-in, locking-, snapping-, turning-, screwing- or the like means not shown in more detail, the additional chamber 18 hangs underneath from the main chamber 12 because of the provided strips or bands 44 (see 2B). While inclining the main chamber 12 for consuming a beverage 32 being therein for example, the additional chamber 18 remains unchangeably in a horizontal position as a result of the strips 44 (see 2C) giving way, whereby a spilling of the content kept within the additional chamber 18 out of the additional chamber 18 is avoided. So it is possible to consume for example a beverage out of the main chamber 12 and to simultaneously take a solid foodstuff, for example peanuts 30, out of the additional chamber 18 being disposed underneath (see FIG. 2D).

Figure 2E:
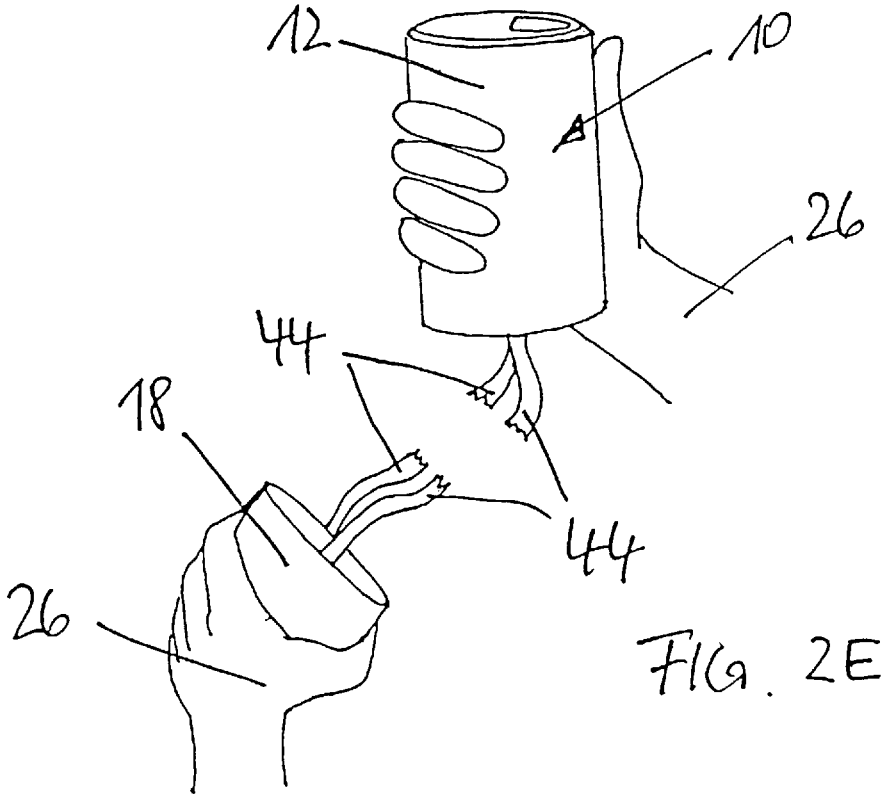
Figure 4A:
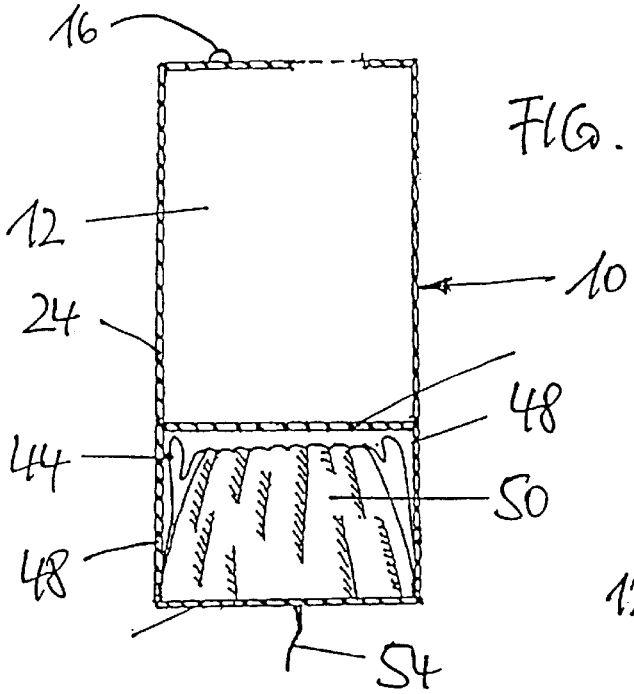
Figure 4B:
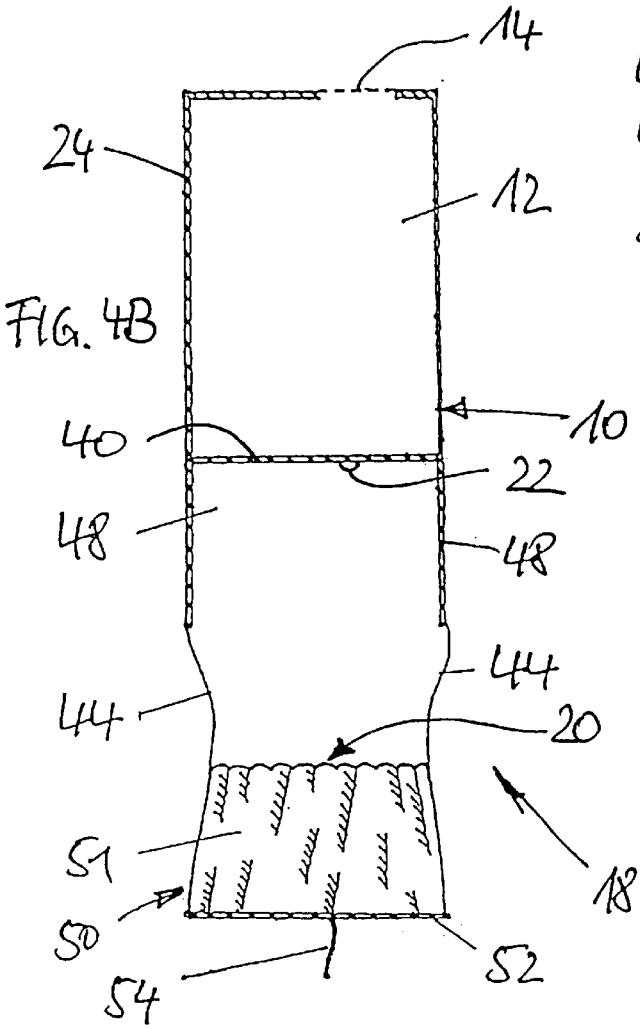

Moreover, the additional chamber 18 can be separated from the main chamber 12 by separating the strips 44 (see FIG. 2E).

Figure 3:
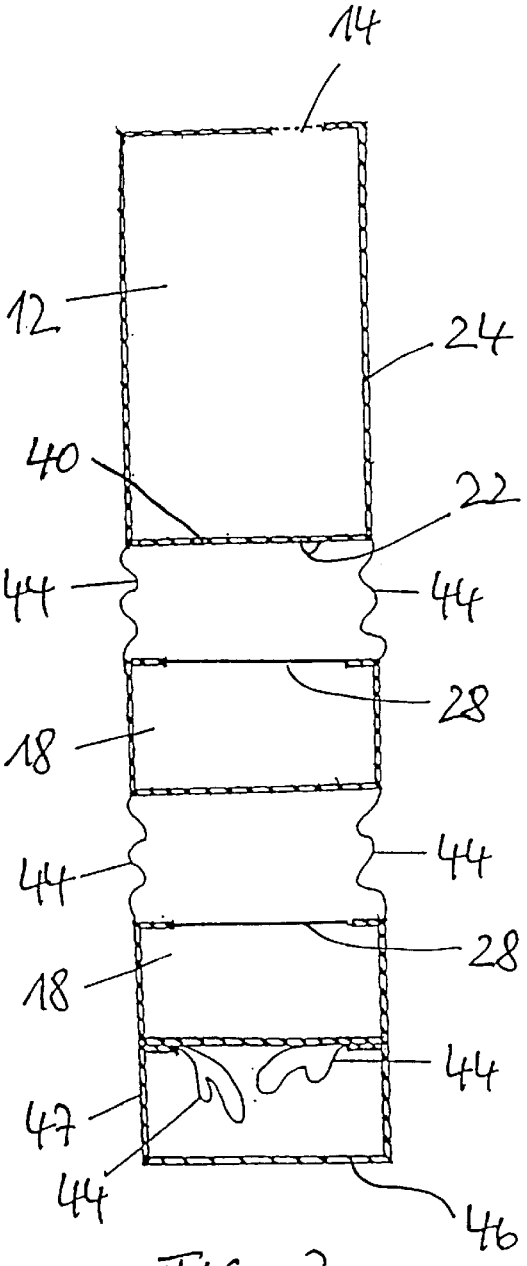

The embodiment of the container 10 with respect to FIG. 3 only differs from that one with respect to Figs. 1A, 1B and 2A to 2E in the fact that one or more further similar additional chambers or additional containers 18, respectively, can be added to one additional chamber or additional container 18, respectively, also coupled to each other by the strips 44.

The embodiment of the container 10 according to the invention with respect to FIGS. 4A and 4B and 5A to 5E essentially corresponds to that one with respect to FIGS. 1A, 1B and 2A to 2E. Therefore, same components are provided with identical reference numbers.

The container 10 consists of a main chamber or main container 12, respectively, an accessory part to the main chamber 12 in form of a side wall 48 extending beyond the bottom side 22, which is tightly connected to the main chamber 12 and to which strips 44 are fixed, and a bag or the like element 50 as additional chamber 18.

The bag 50 has a side wall 51 in particular being essentially flexible and a bottom plate 52 in particular being essentially rigid provided with an element 54 for pulling out, by means of which the bag 50 can be pulled out of the accessory part 48 of the main chamber 12 and remains hanging on the strips 44 beneath the main chamber 12. The bag 50 is disposed within the side wall 48 of the main chamber 12 before use, whereby the rigid bottom plate 52 thereof is connected to the lower edge of the accessory part 48 of the main chamber 12 by a half-rigid, eventually tearable conjunction. The strips 44 can be located within the accessory part 48 of the main chamber 12 or at the outer circumference thereof.

Figure 5A:
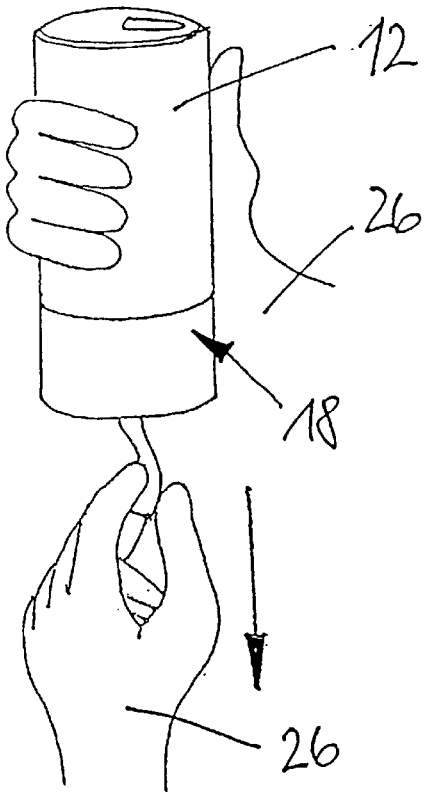
Figure 5B:
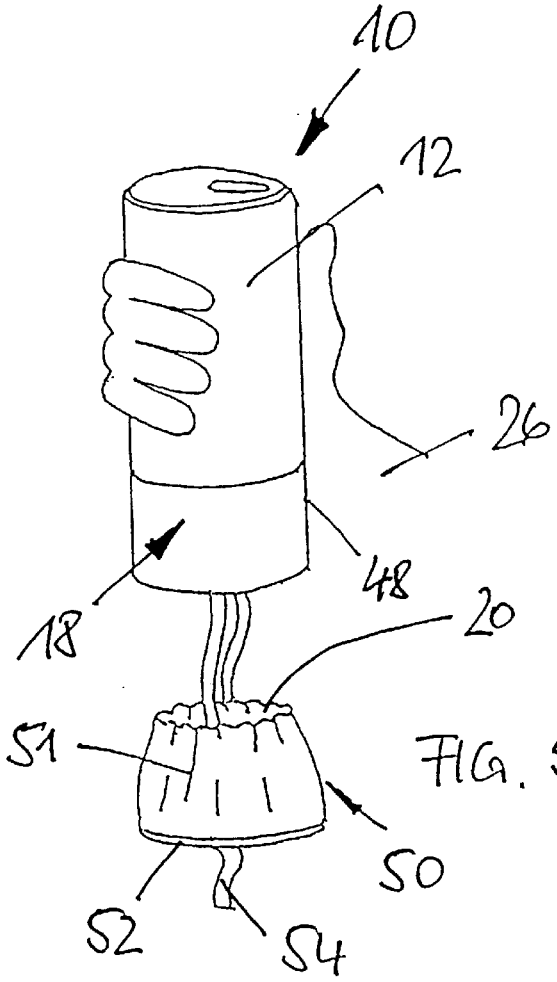
Figure 5C:
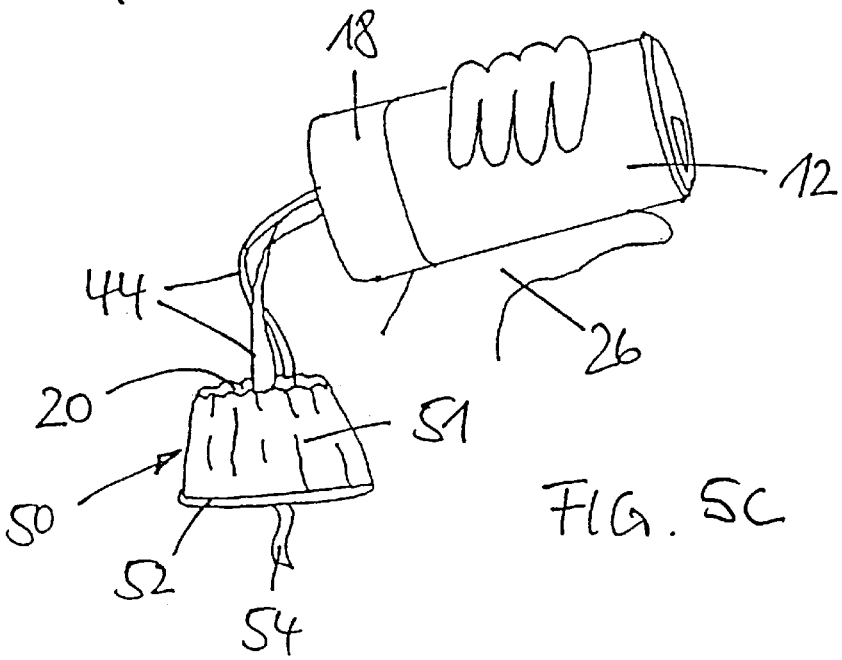

With respect to FIGS. 5A to 5D someone takes the container 10 according to the invention in one hand 26 and with the other hand 26 pulls the element 54 for pulling the bag 50 out of the accessory part 48 which is mounted on the bottom plate 52 (see FIG. 5A). In this way the bag 50 is separated from the accessory part 48 and remains hanging beneath the main chamber 12 (see FIG. 5B). In consumpting during which the main chamber 12 is inclined with the hand 26, the strips 44 are giving away the connection such that the bag 50 remains in the horizontal position (see FIG. 5C), whereby it is avoided that the content kept therein is spilled. In this way, one can drink out of the upper main chamber 12 and can simultaneously take solid food stuffs, as for example peanuts 42, out of the lower additional chamber 18 in form of a bag 50 (see FIG. 5D).

The bag 50 can be completely separated from the main chamber 12 and the container 10 by separating the strips 44 (see FIG. 5E).

Figure 6:
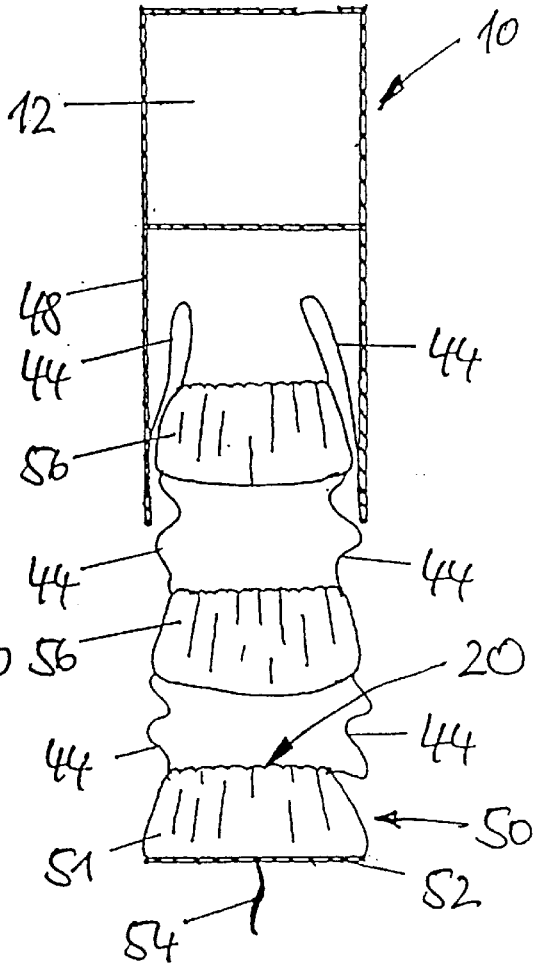

The embodiment of the container 10 with respect to FIG. 6 finally only differs from that one with respect to FIGS. 4A, 4B and 5A to 5D in that one or more further similar bags 56 are provided beside the bag 50 hanging on strips 44 below each other whereby only the lowest bag 50 has a rigid bottom plate 52 with an element 54 for pulling out.

We claim:

1. A container for conserving at least two of a group consisting of different solids and liquids, and for delivering these by corresponding openings, the container having a main chamber and at least one additional chamber whereby the main chamber and the at least on addition chamber are separated from each other by a partition wall for avoiding a mutual contact of the different contents conserved in the container, wherein the main chamber and the at least one additional chamber are formed separably from each other and wherein the main chamber and the at least one additional chamber are connected to each other by flexible connecting elements affixed to each of the chambers to permit the at least one additional chamber to be suspended in spaced relation from the main chamber.

2. A container according to claim 1 wherein the main chamber and the at least one additional chamber are integrally connected by the partition wall of the container.

3. A container according to claim 1 wherein the at least one additional chamber at least partially extends into the main chamber and the main chamber and the at least one additional chamber are integrally connected by the partition wall of the container.

4. A container according to claim 1 wherein the main chamber and the at least one additional chamber are connectable to each other by at least one of the group consisting of a plugging-in-locking means, snapping means, turning means, and screwing means and an adhesive sheet.

5. A container according to claim 4 wherein the flexible connecting elements are tearable to permit separating of the main chamber and the at least one additional chamber.

6. A container according to claim 1 wherein the at least one additional chamber is disposed adjacent to the main chamber and opposite to the opening of the main chamber.

7. A container according to claim 1 wherein the at least one additional chamber comprises a bottom plate and a rigid side wall which extends to an adjacent wall of the main chamber.

8. A container according to claim 1 wherein the at least one additional chamber comprises a bottom plate which is receivable by an adjacent wall of the main chamber extending beyond the bottom side of the main chamber.

9. A container according to claim 1 wherein at least one of the openings of the main chamber and the at least one additional chamber are closeable by a closure selected from the group consisting of aluminum, plastic cardboard, and an adhesive label.

* * * * *